US007721509B2

(12) United States Patent
Vissers

(10) Patent No.: US 7,721,509 B2
(45) Date of Patent: May 25, 2010

(54) DEVICE FOR PACKING ITEMS IN A BOX, AND A METHOD FOR THE SAME

(75) Inventor: Eugenio Wilhelmus Gerardus Vissers, Heeze (NL)

(73) Assignee: Robert Bosch Verpakkingsmachines B.V., Weert (NL)

( * ) Notice: Subject to any disclaimer, the term of this patent is extended or adjusted under 35 U.S.C. 154(b) by 0 days.

(21) Appl. No.: 11/849,504

(22) Filed: Sep. 4, 2007

(65) Prior Publication Data

US 2008/0053039 A1 Mar. 6, 2008

(30) Foreign Application Priority Data

Sep. 6, 2006 (NL) ..... 1032449

(51) Int. Cl.
*B65B 5/08* (2006.01)

(52) U.S. Cl. ..... 53/252; 53/260; 53/542

(58) Field of Classification Search ..... 53/147, 53/247, 250, 251, 252, 260, 537, 542, 543, 53/443, 448, 473, 475

See application file for complete search history.

(56) References Cited

U.S. PATENT DOCUMENTS

| | | | | | |
|---|---|---|---|---|---|
| 2,633,280 | A * | 3/1953 | Frank | 53/537 |
| 2,834,167 | A * | 5/1958 | Loveridge | 53/539 |
| 2,956,381 | A * | 10/1960 | Chauvin et al. | 53/247 |
| 3,069,823 | A * | 12/1962 | Schmid | 53/543 |
| 3,562,775 | A * | 2/1971 | Mullins | 53/542 |
| 3,584,432 | A * | 6/1971 | Mayer, Jr. | 53/537 |
| 3,941,236 | A * | 3/1976 | Hagedorn | 53/537 |
| 4,003,185 | A * | 1/1977 | Goff | 53/543 |
| 4,398,383 | A | 8/1983 | Prakken | |
| 4,534,153 | A * | 8/1985 | Nowicki | 53/252 |
| 4,660,352 | A * | 4/1987 | Deines et al. | 53/543 |
| 4,713,926 | A * | 12/1987 | Mennie et al. | 53/251 |
| 4,843,797 | A * | 7/1989 | Butterly et al. | 53/543 |
| 4,864,801 | A | 9/1989 | Fallas | |
| 4,942,720 | A * | 7/1990 | Berney | 53/543 |
| 5,195,305 | A * | 3/1993 | Dambrosio et al. | 53/260 |
| 6,164,045 | A * | 12/2000 | Focke et al. | 53/543 |
| 7,096,650 | B2 * | 8/2006 | Van Dam | 53/247 |
| 2003/0145562 | A1 * | 8/2003 | Statham et al. | 53/247 |

* cited by examiner

*Primary Examiner*—Louis K Huynh
(74) *Attorney, Agent, or Firm*—Ladas & Parry, LLP

(57) ABSTRACT

A device for packing items in a box is provided with a conveyor for supplying items in a conveyance direction, a pushing device comprising a pressure plate, which pressure plate is movable in a horizontal pushing direction extending transversely to the conveyance direction, for moving at least one item onto a flap that is movable from a closed position to an open position and vice versa, a box being positionable below the flap. The device is additionally provided with two guide plates situated on either side of the flap, which guide plates extend transversely to the pressure plate. The device is further provided with a retaining plate extending parallel to the pressure plate and movable in the pushing direction. The device is also provided with a stop situated between the retaining plate and the pushing device, which stop is situated at a distance above the flap that is less than the height of the item, the item and/or the stop being deformable during the movement of the item on the flap.

22 Claims, 6 Drawing Sheets

DEVICE FOR PACKING ITEMS IN A BOX, AND A METHOD FOR THE SAME

BACKGROUND OF THE INVENTION

The invention relates to a device for packing items in a box, which device is provided with a conveyor for supplying items in a conveyance direction, a pushing device comprising a pressure plate, which pressure plate is movable in a horizontal pushing direction extending transversely to the conveyance direction, for moving at least one item onto a flap that is movable from a closed position to an open position and vice versa, a box being positionable below the flap, which device is additionally provided with two guide plates situated on either side of the flap, which guide plates extend transversely to the pressure plate.

The invention also relates to a method for packing items in a box by means of such a device.

Items are, for example, bags, small boxes, bottles, jars, packets etc.

In such a device and method disclosed by American patent U.S. Pat. No. 4,864,801, items such as bags are conveyed in a virtually lying position by means of a conveyor until the bags are pressed against a stop plate positioned at an angle and are set substantially upright. A number of bags are then positioned simultaneously by means of a pressure plate on a flap in a pushing direction extending transversely to the conveyance direction. Guide plates are disposed on either side of the flap, a guide plate being situated at the same angle as the stop plate. After that, the guide plate positioned at an angle is tilted to a vertically extending position. The flap is then opened, and the bags standing on the flap fall into a box standing ready below the flap.

A disadvantage of a guide plate positioned at an angle is that the bags standing on the flap shift relatively easily in relation to each other, for example if a following row of bags is pressed against a row of bags already standing on the flap. There is then a risk that the rows will be disturbed and will not be positioned in the correct configuration on the flap. This upsets the placing of the bags in the box.

SUMMARY OF THE INVENTION

The object of the invention is to provide a device by means of which items can be placed accurately in a box.

This object is achieved with the device according to the invention in that the device is provided with a retaining plate extending parallel to the pressure plate and movable in the pushing direction, which device is further provided with a stop situated between the retaining plate and the pushing device, which stop is situated at a distance above the flap that is less than the height of the item, the item and/or the stop being deformable during the movement of the item on the flap.

By providing the retaining plate which is movable in the pushing direction, it is ensured that items cannot accidentally shift in the pushing direction. The retaining plate is preferably moved simultaneously with the items in the pushing direction, the items being situated firmly between the retaining plate and the pressure plate. In this way it is ensured that the items positioned on the flap are in a compact orientation resting against each other.

The stop retains items standing on the flap that have a tendency to fall over in the direction of the pressure plate. When items are being moved by means of the pressure plate from the conveyance direction, the items are pushed past the stop and are moved in the pushing direction onto the flap. The stop must be flexible and deformable here and/or the items themselves must be capable of being temporarily deformed.

It has to be noticed that U.S. Pat. No. 4,398,383 discloses a device for packing items in a box. This device is provided with a pressure plate which can tilt about a pivot and is not movable in a horizontal direction transversely to a conveyance direction of the items. The device according to this American patent is provided with a stop that pivots by means of a drive. A disadvantage of such a pivoting stop is that a separate drive is needed for it, the control of which drive must be synchronised with the movement of the pressure plate.

One embodiment of the device according to the invention is characterized in that the pressure plate can be passed underneath the stop.

Such a movement is possible, for example, if the height of the pressure plate is less than the distance between the stop and the flap, so that the pressure plate can be passed underneath the stop without any hindrance.

The stop can be a strip extending transversely to the guide plate, a bar extending transversely to the guide plate, or a bar extending parallel to the guide plate, it being so that in each embodiment of the stop, said stop in an easy and efficient manner prevents the article from accidentally swinging or falling in the direction of the pressure plate.

Another embodiment of the device according to the invention is characterised in that the pushing device is provided with a stop plate connected to the pressure plate and extending transversely to the pressure plate.

The stop plate connected to the pressure plate ensures that during the movement of items on the flap, following items moving in the conveyance direction are retained. During the return movement of the stop plate to the initial position, these items are moved further in the conveyance direction by the conveyor until said items are situated opposite the pressure plate. Through the combination of the pressure plate and the stop plate, a simple, reliable device is obtained.

Yet another embodiment of the device according to the invention is characterised in that the conveyor is provided with guides for guiding upright bags having a top seam, the top seam extending virtually parallel to the conveyance direction.

The bags are held in the upright position by the guides, so that the bags cannot accidentally fall over.

It is pointed out that in the case of the device according to the abovementioned American patent U.S. Pat. No. 4,864,801 the bags first fall over and are then moved back into a substantially upright position by the plate disposed at an angle. There is a risk here of a bag falling under another bag and ultimately being, as it were, upside down, which is, of course, undesirable. This also makes the reliability and accuracy of this device limited.

Yet another embodiment of the device according to the invention is characterised in that the guide plates extend virtually parallel to each other.

Owing to the fact that the guide plates extend virtually parallel to each other, items once placed on the flap will have virtually no space to shift in relation to each other, so that good positioning of the objects relative to each other is ensured.

Another embodiment of the device according to the invention is characterised in that the guide plates, at least near the pushing device, can be moved away from and towards each other.

For movement of items between the guide plates, the guide plates are preferably moved away from each other at least near the pushing device, so that the items can be positioned between the guide plates in a simple manner. On a side facing away from the pushing device, the guide plates do not need to be moved away from each other, and can be at the ultimate desired distance from each other, the items being moved a little more towards each other while they are being moved in the pushing direction by the guide plates. After all items have been placed on the flap, the guide plates are moved towards each other, with the result that the items are pressed firmly against each other by the guide plate. In the process, the items are also pressed against each other between the pressure plate and the retaining plate, with the result that a good configuration of items is obtained, which items, simply by opening the flap, will then fall into a box standing below the flap.

Yet another embodiment of the device according to the invention is characterised in that one of the guide plates forms a stop for a bag supplied by means of the conveyor.

In this way the guide plate forms both a stop for items moving in the conveyance direction and a guide for items moving in the pushing direction. This makes the construction of the device relatively simple.

Yet another embodiment of the device according to the invention is characterised in that the flap comprises at least two supporting plates that are movable in a plane away from and towards each other.

Having supporting plates moving away from each other means that the box can be situated a relatively short distance below the flap, with the result that the distance that the items standing ready on the flap have to be moved into the box is relatively short.

With fully pivoting supporting plates, such as those used according to the abovementioned American patent U.S. Pat. No. 4,864,801, the items have to be moved a relatively great distance because of the space required for pivoting the supporting plates. Because of the relatively great distance, there is a risk here of damage to the products present in the items.

BRIEF DESCRIPTION OF THE DRAWINGS

The invention will be explained in greater detail with reference to the drawings, in which.

Corresponding parts are provided with the same reference numeral in the figures.

DETAILED DESCRIPTION OF THE DRAWINGS

Figure 1:
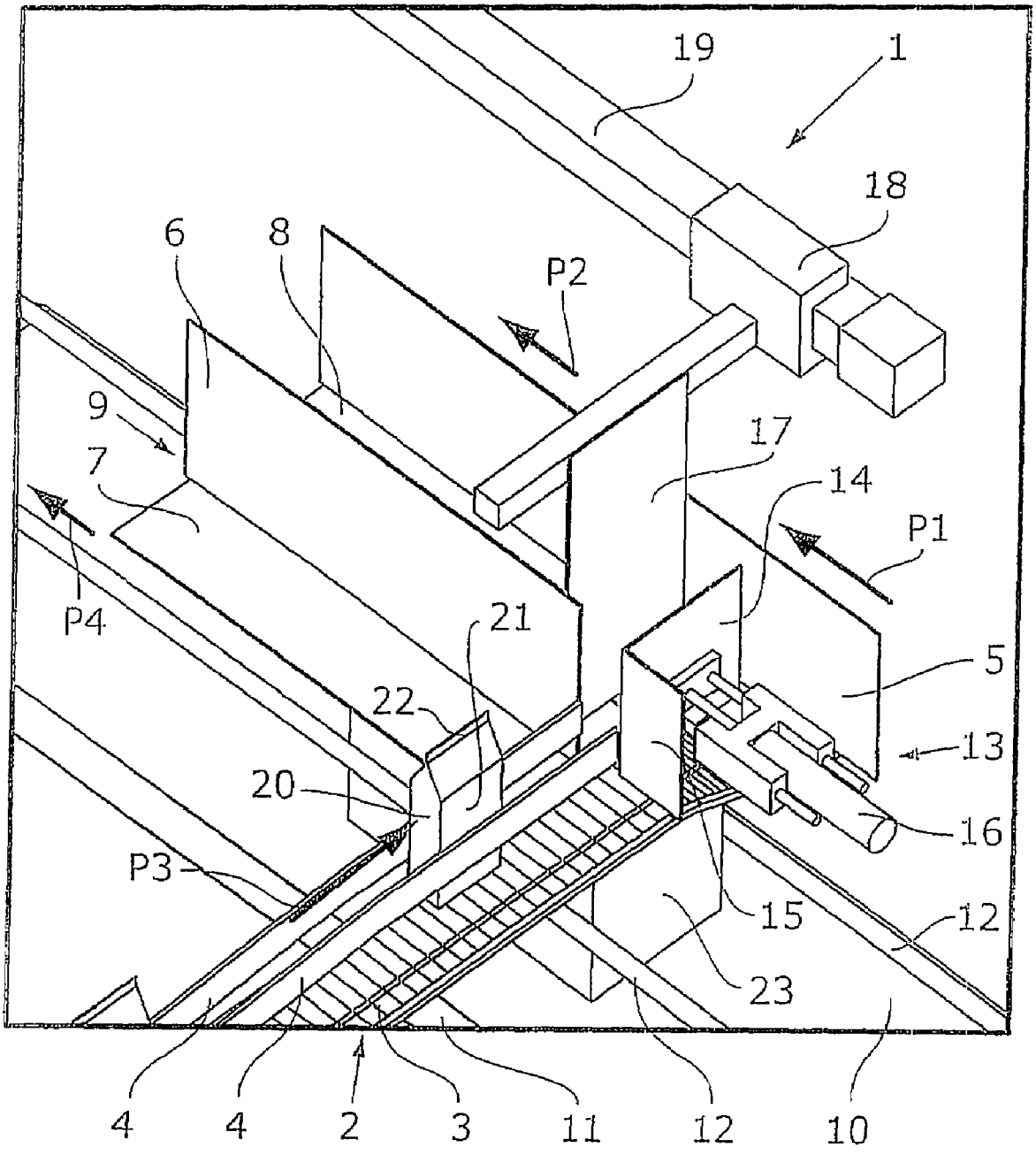
FIG. 1 is a perspective view of a first embodiment of a device according to the invention.

FIG. 1 shows a first embodiment of a device 1 according to the invention, which is provided with a conveyor 2 comprising an endless conveyor belt 3 and also two guides 4 extending parallel to each other. Situated opposite one end of the conveyor 2 is a guide plate 5 extending transversely to said conveyor. A second guide plate 6 extends parallel to the guide plate 5. The guide plates 5, 6 extend transversely to two supporting plates 7, 8, which are movable in a plane away from and towards each other. The supporting plates 7, 8 form a flap 9, which can be moved from a closed position shown in FIG. 1 to an open position shown in FIG. 3. Disposed below the flap 9 is a further conveyor 10, which extends transversely to the conveyor 2, which conveyor 10 comprises an endless belt 11 and two guides 12 extending parallel to the endless belt 11. The device 1 furthermore comprises a pushing device 13, which comprises a pressure plate 14 extending transversely to the guide plates 5, 6, and a stop plate 15 extending parallel to the guide plates. The pressure plate 14 together with the stop plate 15 can be moved by means of a pneumatic device 16 in a direction opposite to the direction indicated by arrow P1. The device 1 additionally comprises a retaining plate 17 situated between the guide plates 5, 6, which retaining plate at the side facing away from the flap 9 is connected to a slide 18, which can be moved along a rail 19 by means of a drive (not shown) in a direction opposite to the direction indicated by arrow P2. A bar (not shown) extends between the guide plates 5, 6, which bar acts as a stop and is situated at a distance above the flap 9 that is less than the height of the bags 20 to be packed.

By means of the conveyor 2, bags 20 are movable in the direction indicated by arrow P3, in the direction of the guide plate 5. The bags 20 are in an upright position, longitudinal sides 21 of the bags resting against the guides 4. A top longitudinal seam 22 of the bag extends parallel to the conveyance direction indicated by arrow P3. Owing to the fact that the bags 20 rest with both longitudinal sides 21 against the guides 4, the bags 20 are well supported and have no tendency to fall over.

By means of the conveyor 10, boxes are moved in the direction indicated by arrow P4.

In the situation shown in FIG. 1 an empty box 23 is present below the flap 9, a number of rows of bags 20 having to be placed in the box 23.

The device 1 works as follows:

FIG. 1 shows the situation in which no bag 20 at all is yet on the flap 9. A bag 20 is moved in the direction indicated by arrow P3, until the bag 20 is resting against the guide plate 5. The retaining plate 17 here is in a position virtually parallel to the guide 4 and near an end of the guide plate 6 situated opposite the pressure plate 14. The pressure plate 14 here is in a position parallel to the other guide 4. Through these positions of the pressure plate 14 and the retaining plate 17, the bag 20 is positioned accurately resting against the guide plate 5, without risk of falling over or tilting. A second bag is then conveyed by means of the conveyor 2 in the direction indicated by arrow P3, until said second bag is resting against the first bag. A row of bags comprising two bags has now been formed. By means of a control unit, the pressure plate 14 is then moved by the device 16 in the direction indicated by arrow P1, so that the bags resting against the pressure plate 14 are also moved in the direction indicated by arrow P1. Simultaneously with the movement of the pressure plate 14, the retaining plate 17 is moved in the direction indicated by arrow P2. The row of bags is held firmly between the retaining plate 17 and the pressure plate 14 here, so that the bags 20 cannot fall over. The bags 20 are passed underneath the bar here, during which the upper side of the bags 20 is elastically deformed. At the head end of the bags, the bags 20 are guided by the guide plates 5, 6. In this way the orientation of the bags 20 is clearly determined by the retaining plate 17, the pressure plate 14 and the guide plates 5, 6. Once the pressure plate 14 is in a position near the guide plate 6, the stop plate 15 extends virtually in line with the guide plate 6 (see FIG. 2), and following bags 20 that are being transported in the direction indicated by arrow P3 are retained by stop plate 15. After the pressure plate 14 has moved in the direction indicated by arrow P1 over a distance that virtually corresponds to the width of the bags 20, the pressure plate 14 is moved in a direction opposite to arrow P1 until the pressure plate 14 again assumes the position shown in FIG. 1. The bar prevents the bags 20 from falling over in the direction opposite to arrow P1.

Two new bags are then conveyed in the direction indicated by arrow P3 until the front bag is resting against the guide plate 5. After that, the pressure plate 14 is again conveyed in the direction indicated by arrow P1, so that a row of two bags is again placed on the flap 9. The retaining plate 17 is moved simultaneously with the movement of the pressure plate 14, so that the row placed earlier is also moved in the direction indicated by arrow P1.

Figure 2:
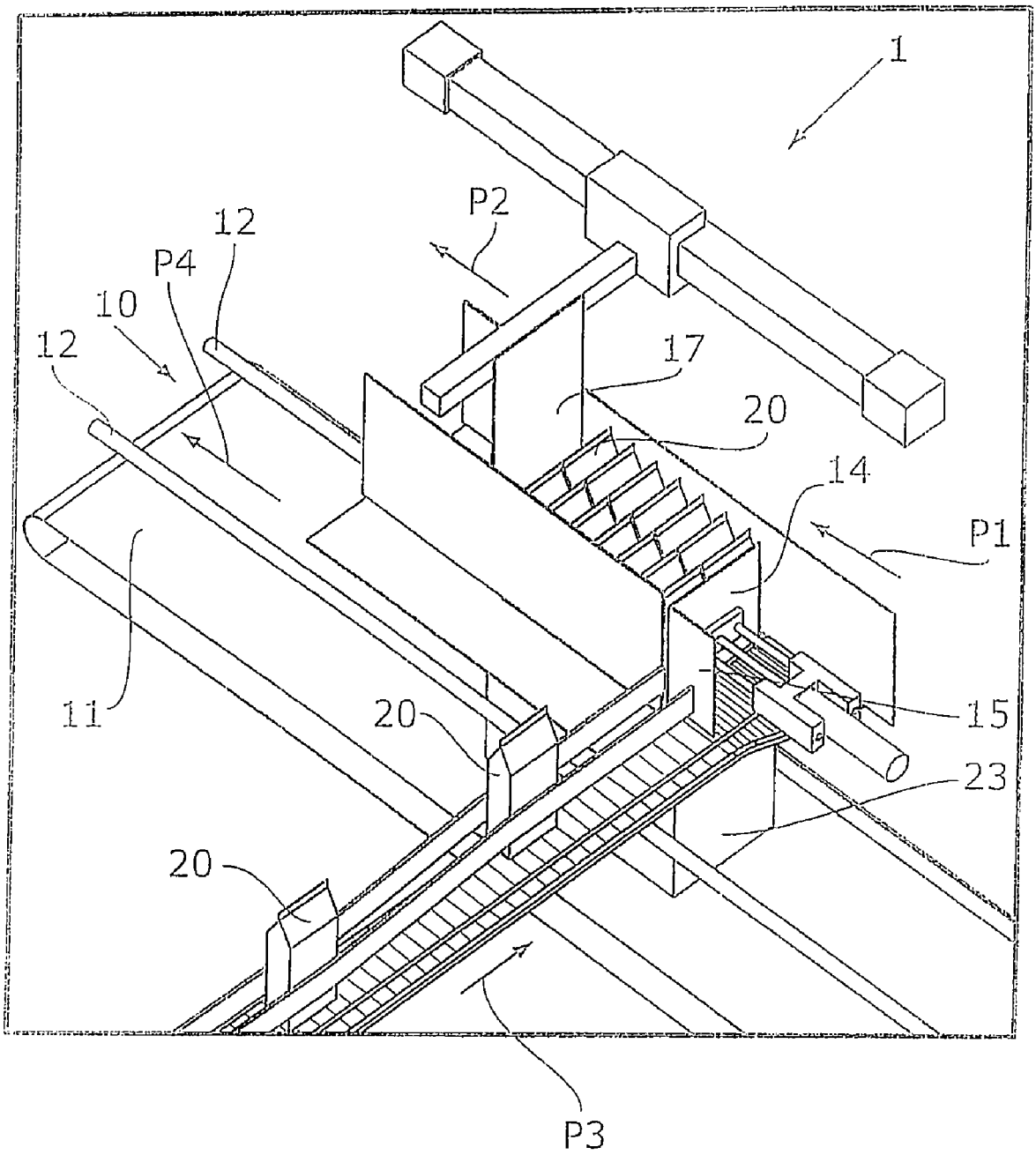
FIG. 2 shows the device illustrated in FIG. 1 at a different phase of the filling of a box with bags.

After a desired number of rows of bags has been placed on the flap 9, the rows of bags are pressed firmly against each other by the pressure plate 14 (see FIG. 2). While they are being pressed against each other, following bags 20 moving in the direction indicated by arrow P3 are retained by the stop plate 15.

Figure 3:
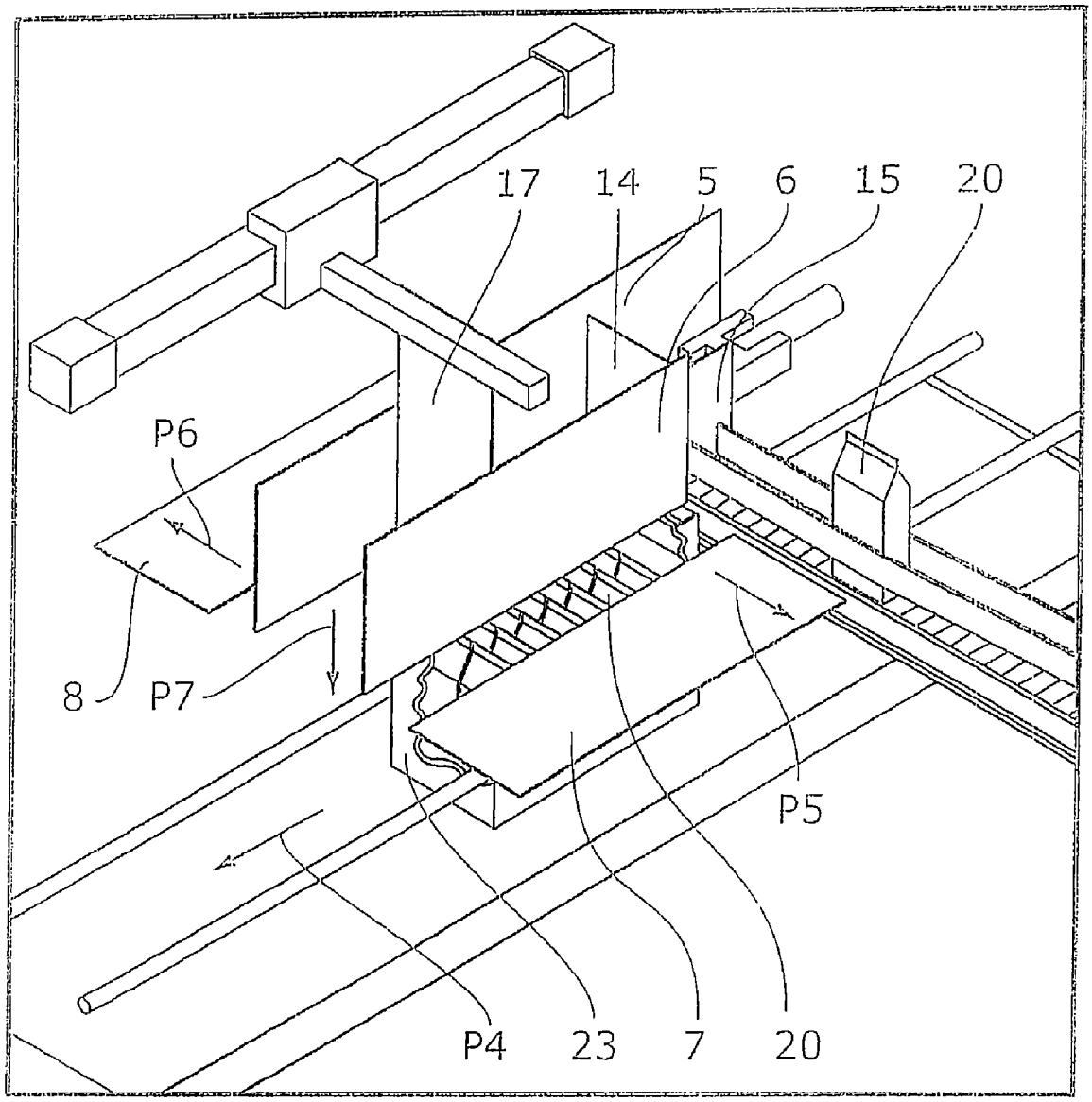
FIG. 3 is a perspective view of the device illustrated in FIG. 1 in yet another phase of the filling of a box with bags.

Subsequently, as shown in FIG. 3, the supporting plates 7, 8 are moved away from each other in the directions indicated by arrows P5, P6, with the result that the bags 20 are no longer supported and, under the influence of gravity, fall in the direction indicated by arrow P7 into the box 23 standing ready below the flap. Owing to the fact that the box 23 is situated directly below the supporting plates 7, 8 that are moving away from each other, the distance over which the bags 20 are moved in the direction indicated by arrow P7 is relatively short.

The guide plates 5, 6, the retaining plate 17 and the pressure plate 14 are preferably relatively smooth, so as to limit friction between the plates and the bags.

Figure 4:
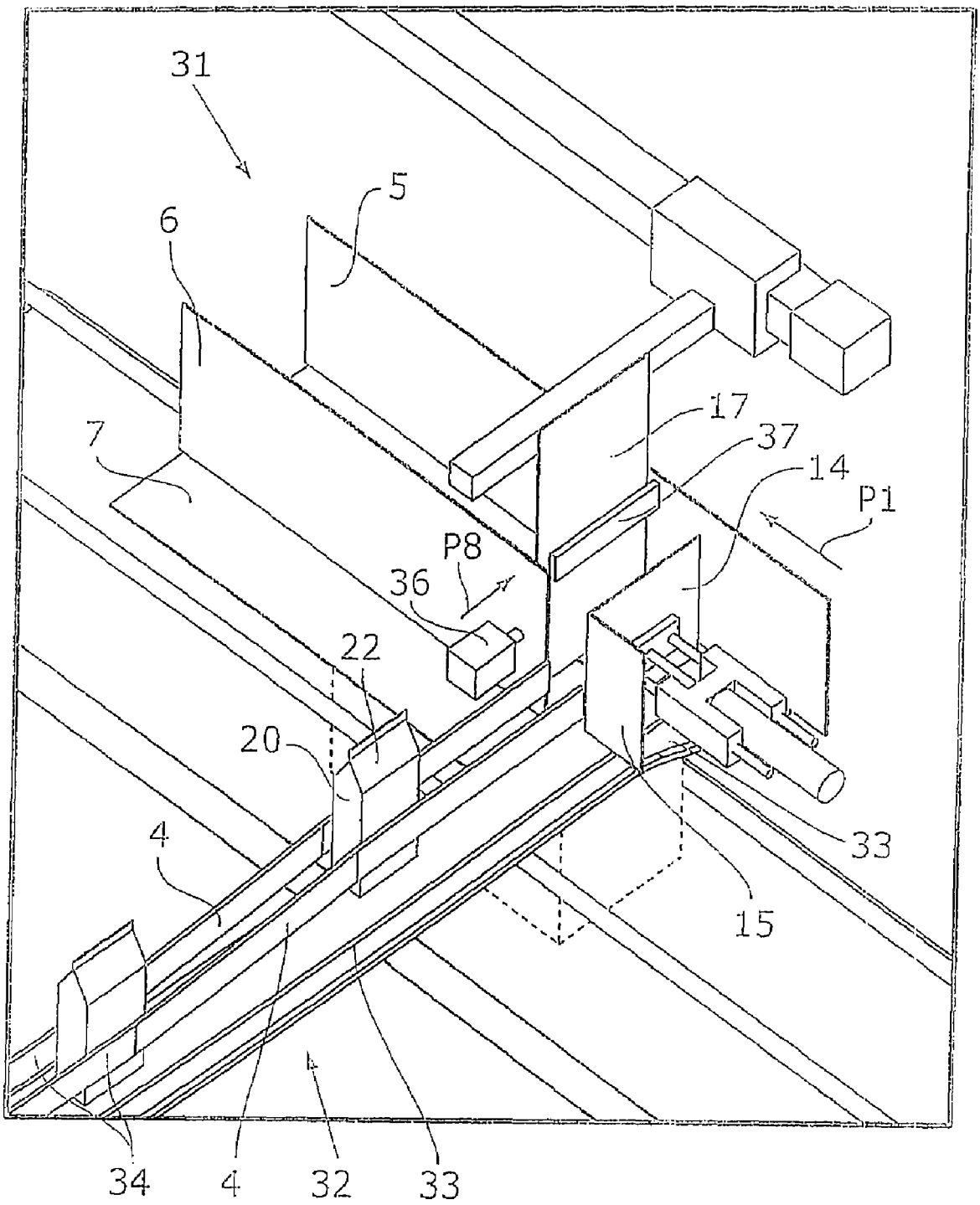
FIG. 4 is a perspective view of a second embodiment of a device according to the invention.
Figure 5:
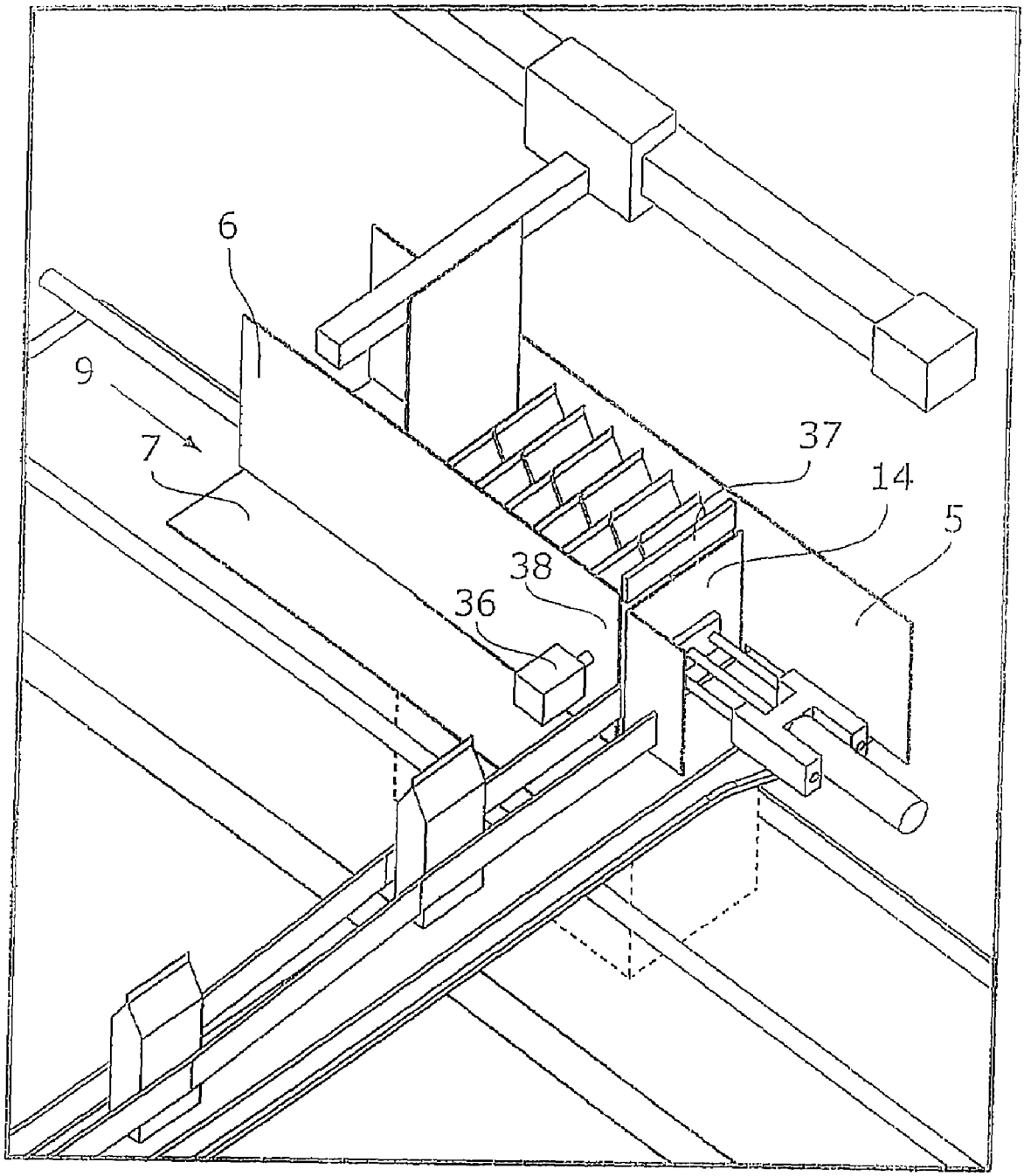
FIG. 5 shows the device illustrated in FIG. 4 during a different phase of the filling of a box.
Figure 6:
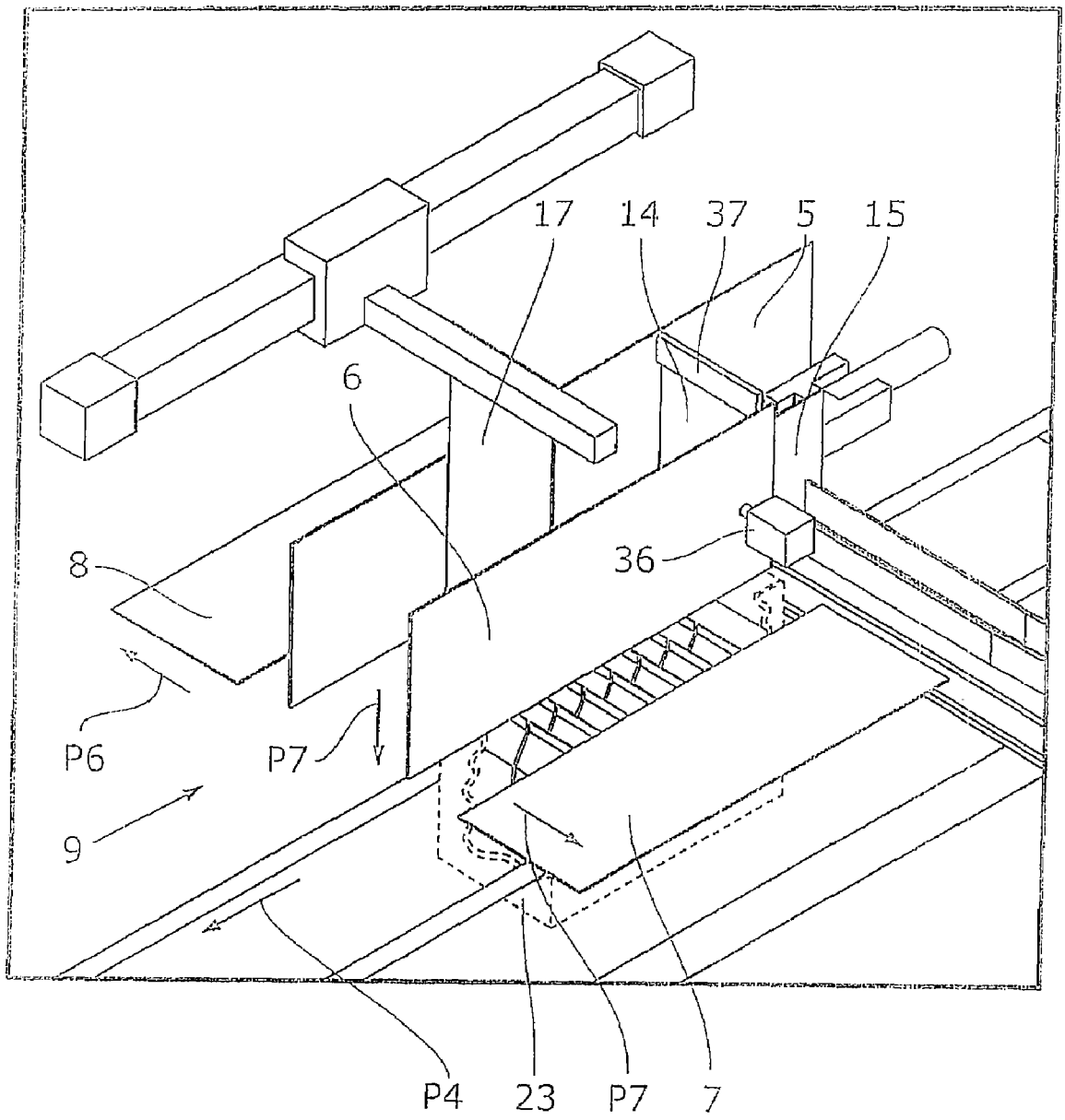
FIG. 6 is a perspective view of the device illustrated in FIG. 4 during yet another phase of the filling of a box with bags.

FIGS. 4-6 show a detail of a second embodiment of a device 31 according to the invention, which is provided with a conveyor 32 comprising an endless conveyor belt 33 and two guides 4 extending parallel to the conveyor belt 33.

The device 31 is additionally provided with a drive 36, by means of which one end of the guide plate 6 situated opposite the pressure plate 14 can be moved in a direction opposite to the direction indicated by arrow P8.

The device 31 is provided with a stop 37 extending transversely to the guide plate 5. The stop 37 extends up to the guide plate 6. The stop 37 is made of a flexible deformable material such as, for example, a brush connected to a metal strip. The brush prevents bags on either side of the stop 37 from falling over. The distance of the brushes from the flap is less than the height of the bag here. A force is exerted upon the brush by the bags 20 while the pressure plate 14 is being moved in the direction indicated by arrow P1, with the result that the brush is deformed and the bags can be moved from one side of the stop 37 to the other side of the stop 37 without damage occurring to the bags in the process. During this process the pressure plate 14 is passed underneath the stop 37.

The mode of operation of the device 31 is largely similar to that of the device 1 described above. One difference is that during the formation of a number of rows on the flap 9 the end 38 of the guide plate 6 is moved away from the guide plate 5 in a direction opposite to that of arrow P8, with the result that the distance between the guide plates 5, 6 is relatively great near the end 38, so that a row of bags can easily be pressed in between the guide plates 5, 6. The distance between the guide plates 5, 6 on a side facing away from the pressure plate 14 is preferably equal to the desired distance. During the movement in the direction indicated by arrow P1 the bags are also pressed towards each other here. As soon as the desired number of rows is formed on the flap 9, the end 38 of the guide plate 6 is moved in the direction indicated by arrow P8, so that all bags are positioned in the same way on flap 9. As shown in FIG. 6, the flap 9 is then opened, and the bags fall in the direction indicated by arrow P7 into the box 23 standing ready below the flap 9.

It is also possible to move the entire plate 6 in and opposite to the direction indicated by arrow P8.

It is also possible to provide the guide plates 5, 6 with special coatings or materials in order to reduce the friction between the bags and the guide plates.

It is also possible not only to place the bags in the boxes under the influence of gravity, but also to push the bags into the box by means of a plate pressing upon the bag from the upper side.

It is also possible to provide the flap 9 with hinged supporting plates. However, this means that the distance that the bags have to cover in the direction indicated by arrow P7 is greater.

It is also possible to form rows of more than two bags, or to form a 'row' of only a single bag.

It is also possible to supply the bags separated, in which case the stop plate may be dispensed with, if desired.

In the case of relatively flexible bags it is also possible to make the stop rigid, in which case the bags themselves are deformed briefly while they are being moved past the stop.

It is also possible to make the stop in the form of a tensioned elastic wire extending parallel to or transversely to the pressure plate, or having another orientation relative to the pressure plate, the wire or wires resting against the upper side of the bags, with the result that the bags are prevented in a simple manner from falling over.

It is also possible to move the bags in the conveyance direction, in which case the top seam, for example, is positioned transversely to the conveyance direction.

The guide plates can also be in the form of endless conveyor belts extending in the direction of the box to be filled. The guide plates can also comprise air bearings, balls or rollers. In the case of such guide plates the friction between the guide plates and the items to be packed is relatively low.

It is also possible to make the supporting plates 7, 8 pivoting, or to make them undergo another type of movement in order to open the flap.

The retaining plate, the pressure plate and the guide plates can be disposed in a slightly conical arrangement, so that when the items fall into the box contact with the plates is reduced relatively rapidly.

The retaining plate is moved simultaneously with an item in the pushing direction. The speed can be the same here as that of the item, or it can be slightly slower, so that the item is compressed slightly.

The invention claimed is:

1. A device for packing items in a box, which device is provided with a conveyor for supplying items in a conveyance direction, a pushing device comprising a pressure plate, which pressure plate is movable in a horizontal pushing direction extending transversely to the conveyance direction, for moving at least one item onto a flap that is movable from a closed position to an open position and vice versa, a box being positionable below the flap, which device is additionally provided with two guide plates situated on either side of the flap, which guide plates extend transversely to the pressure plate, wherein the device is provided with a retaining plate extending parallel to the pressure plate and movable in the pushing direction, which device is further provided with a stop situated between the retaining plate and the pushing device, which stop is situated at a distance above the flap that is less than the height of the item, the item or the stop being deformable as the item is passed underneath the stop during the movement of the item on the flap; wherein the stop is supported by at least one of the guide plates.

2. A device according to claim 1, wherein the pressure plate can be passed underneath the stop.

3. A device according to claim 1, wherein the stop comprises a strip extending transversely to the guide plate.

4. A device according to claim 3, wherein the strip is provided with a deformable brush.

5. A device according to claim 1, wherein the stop comprises at least one bar extending transversely to the guide plate.

6. A device according to claim 1, wherein the pushing device is provided with a stop plate connected to the pressure plate and extending transversely to the pressure plate.

7. A device according to claim 1, wherein the conveyor is provided with guides for guiding upright bags having a top seam, the top seam extending virtually parallel to the conveyance direction.

8. A device according to claim 1, wherein the guide plates extend virtually parallel to each other.

9. A device according to claim 1, wherein the guide plates, at least near the pushing device, can be moved away from and towards each other.

10. A device according to claim 1, wherein one of the guide plates forms a stop for a bag supplied by means of the conveyor.

11. A device according to claim 1, wherein the flap comprises two supporting plates that are movable in a plane away from and towards each other.

12. A device according to claim 1, wherein the device is configured such that the item is capable of being supplied in the conveyance direction by means of the conveyor and moved by means of the pushing device comprising the pressure plate in the horizontal pushing direction extending transversely to the conveyance direction onto the flap that is movable from the closed position to the open position and vice versa, the box being positionable below the flap, and wherein the retaining plate extending parallel to the pressure plate is configured to be moved simultaneously with the item in the pushing direction, the item being capable of being passed underneath the stop situated between the retaining plate and the pushing device, with the item and/or the stop being deformed, after which the pressure plate is configured to be moved in a direction opposite to the pushing direction, while the item is retained by the stop.

13. A device according to claim 12, wherein the retaining plate is configured to be moved simultaneously with a number of items in the pushing direction.

14. A device according to claim 13, wherein the conveyor is configured to convey an item provided with a top seam substantially upright in the conveyance direction, the top seam extending virtually parallel to the conveyance direction.

15. A device according to claim 1, wherein the stop is configured to prevent one or more items on the flap from falling in a direction toward the pressure plate.

16. A device according to claim 1, wherein the stop is deformable.

17. A device according to claim 16, wherein the stop is in the form of a tensioned elastic wire.

18. A device according to claim 1, wherein the pressure plate is configured to move a bag, the stop comprising a brush configured to be deformed as a result of a force being exerted upon the brush by the bag such that the bag is moveable from a first side of the stop to a second side of the stop.

19. A device according to claim 18, wherein the pressure plate is configured to pass underneath the stop when the bag moves from the first side of the stop to the second side of the stop.

20. A device according to claim 1, wherein the stop has a rigid structure, the pressure plate being configured to move a bag, and the rigid structure of the stop being configured to deform the bag when the bag is moved past the stop.

21. A device according to claim 1, wherein a position of the stop is fixed relative to at least one of the guide plates.

22. A device for packing items in a box, which device is provided with a conveyor for supplying items in a conveyance direction, a pushing device comprising a pressure plate, which pressure plate is movable in a horizontal pushing direction extending transversely to the conveyance direction, for moving at least one item onto a flap that is movable from a closed position to an open position and vice versa, a box being positionable below the flap, which device is additionally provided with two guide plates situated on either side of the flap, which guide plates extend transversely to the pressure plate, wherein the device is provided with a retaining plate extending parallel to the pressure plate and movable in the pushing direction, which device is further provided with a stop situated between the retaining plate and the pushing device, which stop is situated at a distance above the flap that is less than the height of the item, the item or the stop being deformable as the item is passed underneath the stop during the movement of the item on the flap; wherein the stop is deformable and wherein the stop is in the form of a tensioned elastic wire.

* * * * *